US006311789B1

(12) United States Patent
Saxman

(10) Patent No.: US 6,311,789 B1
(45) Date of Patent: Nov. 6, 2001

(54) BIT BREAKERS, BITS, SYSTEMS, AND METHODS WITH IMPROVED MAKEUP/ BREAKOUT ENGAGEMENT

(75) Inventor: William C. Saxman, Cedar Hill, TX (US)

(73) Assignee: Halliburton Energy Services, Inc., Carrolton, TX (US)

( * ) Notice: Subject to any disclaimer, the term of this patent is extended or adjusted under 35 U.S.C. 154(b) by 0 days.

(21) Appl. No.: 09/350,218

(22) Filed: Jul. 9, 1999

Related U.S. Application Data

(60) Provisional application No. 60/093,225, filed on Jul. 17, 1998.

(51) Int. Cl.[7] ..... E21B 7/00

(52) U.S. Cl. ..... 175/57; 175/85; 81/57.16; 81/57.2; 269/209

(58) Field of Search ..... 175/424, 327, 175/331, 336, 85, 57, 315; 81/57.16, 57.2, 57.21, 57.34; 269/207, 203, 209; 173/164

(56) References Cited

U.S. PATENT DOCUMENTS 3,363,706 * 1/1968 Feenstra ..... 175/340
3,722,603 * 3/1973 Brown ..... 173/159
4,006,788 * 2/1977 Garner ..... 175/330
4,030,557 * 6/1977 Alvis et al. ..... 175/4.5
4,057,887 * 11/1977 Jones et al. ..... 29/240
4,174,759 * 11/1979 Arbuckle ..... 175/67
4,296,820 10/1981 Loftis .
4,352,399 10/1982 Davis .
4,453,836 * 6/1984 Klima ..... 384/94
4,495,840 1/1985 Freitag et al. .
4,694,551 * 9/1987 Mathews ..... 29/402.08
4,924,954 5/1990 Mead .
5,033,559 7/1991 Fischer .
5,644,956 7/1997 Blackman et al. .
5,791,422 * 8/1998 Liang et al. ..... 175/374
5,839,525 11/1998 Hoffmaster et al. .

* cited by examiner

*Primary Examiner*—Victor Batson
(74) *Attorney, Agent, or Firm*—Groover & Associates; Robert Groover; Betty Formby

(57) ABSTRACT

A bit breaker is formed of a U-shaped base and latchable gate which closes the U. When the gate is in a closed position, evenly spaced chocks on both the base and gate protrude into the central cavity of the bit breaker to engage slots formed in the bit. The bit breaker is designed to be used with either roller cone bits or drag bits.

24 Claims, 11 Drawing Sheets

BIT BREAKERS, BITS, SYSTEMS, AND METHODS WITH IMPROVED MAKEUP/ BREAKOUT ENGAGEMENT

CROSS-REFERENCE TO OTHER APPLICATIONS

This application claims priority from U.S. provisional application 60/093,225 filed Jul. 17 1998, which is hereby incorporated by reference.

BACKGROUND AND SUMMARY OF THE INVENTION

The present application relates generally to drilling tools used in the drilling of oil and gas wells, or similar earth drilling operations, and in particular to disconnection of a threaded rock drill bit from a threaded drill string member.

Background: Drilling

Oil wells and gas wells are drilled by a process of rotary drilling. In a conventional drill rig, as seen in FIG. 5, a drill bit 50 is mounted on the end of a drill string 52. As drilling progresses, more sections of collar and pipe are screwed onto the drill string, which may be several miles long. Surface equipment 51 includes a rotary drive (rotary table or top drive) which turns the string, including the bit at the bottom of the hole, and powerful pumps which pump drilling fluid (or "mud") through the string. The elements of the drill string are connected together by large screw threads.

Roller-Cone and Fixed-Cutter Bits

In contemporary drilling practice, there are two basic categories of rock drill bits: roller-cone bits and fixed cutter bits. Within each of these classifications, a range of sizes and design configurations are available.

A general schematic of a conventional rotary cone bit is shown in FIG. 3B. The most common roller cone bits have three independently rotating "cones" 336 (which may or be not be precisely conical) fitted on three bearings. The cones will have cutting elements 335 or "teeth" attached to, or integral with the cones. The bearings are mounted on "arms" 333 whose other ends are attached to a body 331. There is a threaded drill string connection 334 on the junction of the arms at the upper end of the bit. A further example of this type of rock drill bit is disclosed in U.S. Pat. No. 5,644,956 by Blackman.

A general schematic of a conventional fixed cutter bit 230 is shown in FIG. 2B. The most common fixed cutter bits have at one end a supporting structure referred to as the "bit head" 356. Wear-resistant cutting elements 231 are strategically located on the outer and lower surfaces of the bit head. Slot 240 and an identical slot on the far side of the shank 235 of the bit are explained in conjunction with the bit breaker with which it is used. A further example of this type of rock drill bit is disclosed in U.S. Pat. No. 5,033,559 by Fischer.

Drill bits will need to be replaced for a number of reasons. The most common reason for changing a drill bit is that it wears out and stops drilling. Another reason for changing a drill bit is to utilize a drill bit specifically designed for drilling a formation with the physical properties being drilled or one designed to provide certain performance characteristics, such as directional drilling. Another reason is to utilize a drill bit sized to produce the desired well bore diameter. To achieve the desired drilling and performance characteristics, a wide variety of drill bit designs are available.

Makeup and Breakout

As noted, the elements of the drill string are connected together by heavy threads. When a drill bit wears out or needs to be replaced for other reasons, the drill bit must be removed from the drill string. The torque required for this can be very substantial; for example, for a 26-inch bit, the specified makeup torque can be more than 40,000 pound-feet. (By comparison, the lug nuts on a typical light truck wheel require less than 100 pound-feet or torque.) These very large values of torque are needed to assure that the joint is not only mechanically stable under the high applied forces seen while drilling, but also sealed tightly against the high pressures of mud flow. Once a mud leak begins, the fine abrasive particles entrained in the mud can cause rapid erosion along the leakage channel.

For most of the joints in the string, the piece below the joint can be held by "slips" which support the drill string, while the piece above the joint is turned by mechanical pipe tongs. However, this is more difficult when attaching the drill bit itself, since the drill bit cannot be held by the slips which hold drill pipe or collar.

To keep the drill bit from turning when torque is applied to the joint, a "bit breaker" plate is used. FIG. 2A shows a bit breaker 200 used for fixed-cutter bits (such as shown in FIG. 2B). Bit breaker 200 has a base 210 and two arms 205, which mate with twin milled slots 240 on the shank 235 of the bit 230 to keep the bit from turning in relationship to the bit breaker. A latch 220 is normally included on the bit breaker plates, but this latch does not itself bear on the bit at all. In practice, this latch is often detached and discarded as soon as such a bit breaker plate is first used on the rig floor.

Fixed-cutter bits normally include a shank portion, into which the slots for a breaker tool are milled. Roller cone bits, however, normally do NOT normally include any such extended shank. There are several reasons for this, one of which is the undesirability of loss of mud pressure during passage through the interior of the bit. Another is the high rigidity required of the arm structures (since any bending in service can destroy the bit).

For roller-cone bits, a conventional bit breaker (as shown in FIG. 3A) simply has a cutout in its middle, into which the bit (shown in FIG. 3B) is lowered. The irregularities in this cutout engage the arms of the roller-cone bit, as shown in FIG. 3C.

The bit breaker plate fits into the rotary table. The internal geometry of the bit breaker is shaped so as to engage the bit securely and transmit torque from the rotary table to the drill bit in either right-hand or left-hand rotation. If the rotary table is held fixed, the bit will also be held fixed.

Correct operation of the bit breaker is important during make-up as well as during break-out. Any defect in assembly may lurk undiscovered until the bit is at the bottom of the hole, necessitating an extra trip to replace the bit. Any unexpected trip is extremely undesirable.

The process of "tripping" is required to change the bit. A heavy hoist pulls the entire drill string out of the hole, in stages of (for example) about ninety feet at a time. After each stage of lifting, one "stand" of pipe is unscrewed and laid aside for reassembly (while the weight of the drill string is temporarily supported by another mechanism). Since the total weight of the drill string may be hundreds of tons, and the length of the drill string may be tens of thousands of feet, this is not a trivial job. One trip can require tens of hours and add significant expense in the drilling budget. To resume drilling the entire process must be reversed.

Disadvantages of Available Designs

The standard bit breaker for a three cone bit has a bottom plate, four vertical side plates, and a top plate with an opening configured to engage the drill bit arms above the cones. One disadvantage of this design is that the bit breakers contact the drill bit arms at the lowest possible position, creating the possibility that the arms may be bent during the make-up of the tool joint, which destroys the drill bit. Another disadvantage of this design is that the bit breakers do not always accommodate the different cutting structures of the various design configurations, which can result in breakage of the cutting structure during the make-up of the tool joint. Another disadvantage of this design is that the bit breakers do not always accommodate extended nozzle designs, which can result in breakage or deformation of the nozzle during the make-up of the tool joint. Another disadvantage of this design is that the bit breakers are very heavy, making them physically hazardous and inconvenient to move. Another disadvantage of this design is that manufacturing costs are high as a result of the amount of material, machining, and welding required to build them. Another disadvantage of this design is that the bit breakers are large and bulky, requiring substantial storage space for each tool. Another disadvantage of this design is that it cannot be used to on fixed cutter bits.

The standard bit breaker for a fixed cutter bit is a U-shaped steel plate having a slotted opening sized for sliding engagement with the two parallel slots machined into the shank. These designs often include a safety bar to prevent the bit breaker from sliding off of the drill bit. One disadvantage of this design is that the open end of the tool reduces the tool's resistance to deformation, and widening. Another disadvantage of this design is that the safety bars are often discarded, making the tool more hazardous to use. Another disadvantage of this design is that it cannot be used on roller cone bits.

Since fixed cutter bits use different bit breakers than roller cone bits, a separate bit breaker is needed for every size in each design type. The total cost of manufacturing and inventorying the required number of bit breakers is substantial.

To address these problems, engineers have attempted to design bit breakers that can accommodate a wider range of drill bit sizes. In U.S. Pat. No. 4,495,840, Freitag and Smith disclose a bit breaker having a bottom engageable with the bottom of the bit, a top opening for lowering the bit into the bit breaker, and a pair of slidably mounted stop members for movement inward and outward relative to the opening. This design accommodates extended nozzle designs, and may accommodate drill bits of the next size tool joint. This design fails to accommodate fixed cutter bits, which now account for more than half of the total footage drilled worldwide. Another disadvantage of this design is that it requires a number of machined parts, which increases the manufacturing cost and reduces the reliability of the tool. Another disadvantage of this design is that it is bigger and heavier than conventional bit breakers.

Drill Bit And Make-Up/Break-Out Tool

In the preferred embodiment of the present disclosure, a generally square base has one open end, giving it a u-shape. The base is made of steel or other suitable material and is externally sized for placement in the rotary table of a drilling rig. A gate is pivotally attached at to one end of the open side of the base. A detachable connector such as a dowel pin secures the other end of the gate to the opposite open end of the base.

The base has a centered chuck-opening portion that is shaped to accommodate the cross-section of a roller cone drill bit. Two chocks integral to the base extend into the chuck opening. A third chock integral to the gate also extends into the chuck opening. When the gate is positioned adjacent to the open-end of the base, the three chocks form a symmetrical configuration of protrusions that align with the alternating recesses and protrusions found in the cross-section of a roller cone bit. Thus, when the tool is placed on a roller cone drill bit, the alignment of the chocks between the arms of the drill bit prevent rotation of the drill bit in either direction relative to the tool. Retaining slots formed between the arms of the roller cone bit engage the chocks to fix the vertical position of the bit breaker in relation to the drill bit. Similarly, a series of three equally spaced retaining slots are formed into the shank portion of the fixed cutter bit. The retaining slots engage the chocks to prevent rotation or movement of the drill bit in any direction relative to the tool, and to fix the vertical position of the bit breaker in relation to the drill bit. In this embodiment, the chucking system provides a bit breaker that is adapted for use on both roller cone bits and fixed cutter bits, and which is capable of performing without the many disadvantages of conventional bit breakers.

A significant advantage of the present disclosure is that it is the first bit breaker ever designed to be used for both fixed cutter bits or roller cone bits.

Another advantage of various disclosed embodiments is that roller cone bits are engaged closer to the tool joint, thus reducing the possibility of bending the arms of the drill bit during the make-up of the connection.

Another advantage of various disclosed embodiments is that no contact with the bit's cutting structure occurs, thereby accommodating any cutting structure design safely.

Another advantage of various disclosed embodiments is compatibility with extended nozzles on roller cone bits. (Extended nozzles can be useful for optimal control of fluid flow, but can be damaged by some conventional bit breakers.)

Another advantage of various disclosed embodiments is lower cost than conventional bit breakers as a result of savings in the material, machining, and welding.

Another advantage of various disclosed embodiments is bit breakers with reduced size and weight. This provides a reduced risk of injury on the job.

Another advantage of various disclosed embodiments is less likelihood of deformation and widening of the bit breaker (as compared to a conventional fixed-cutter breaker) during the breakout operation.

Other advantages of the present disclosure will become apparent from the following descriptions, taken in connection with the accompanying drawings, wherein, by way of illustration and example, an embodiment of the disclosed inventions are disclosed.

BRIEF DESCRIPTION OF THE DRAWINGS

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation). The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the disclosed inventions. Thus, the disclosed inventions are not intended to be limited to the embodiments shown, but is to be accorded the widest scope consistent with the principles and features disclosed herein.

Figure 1A:
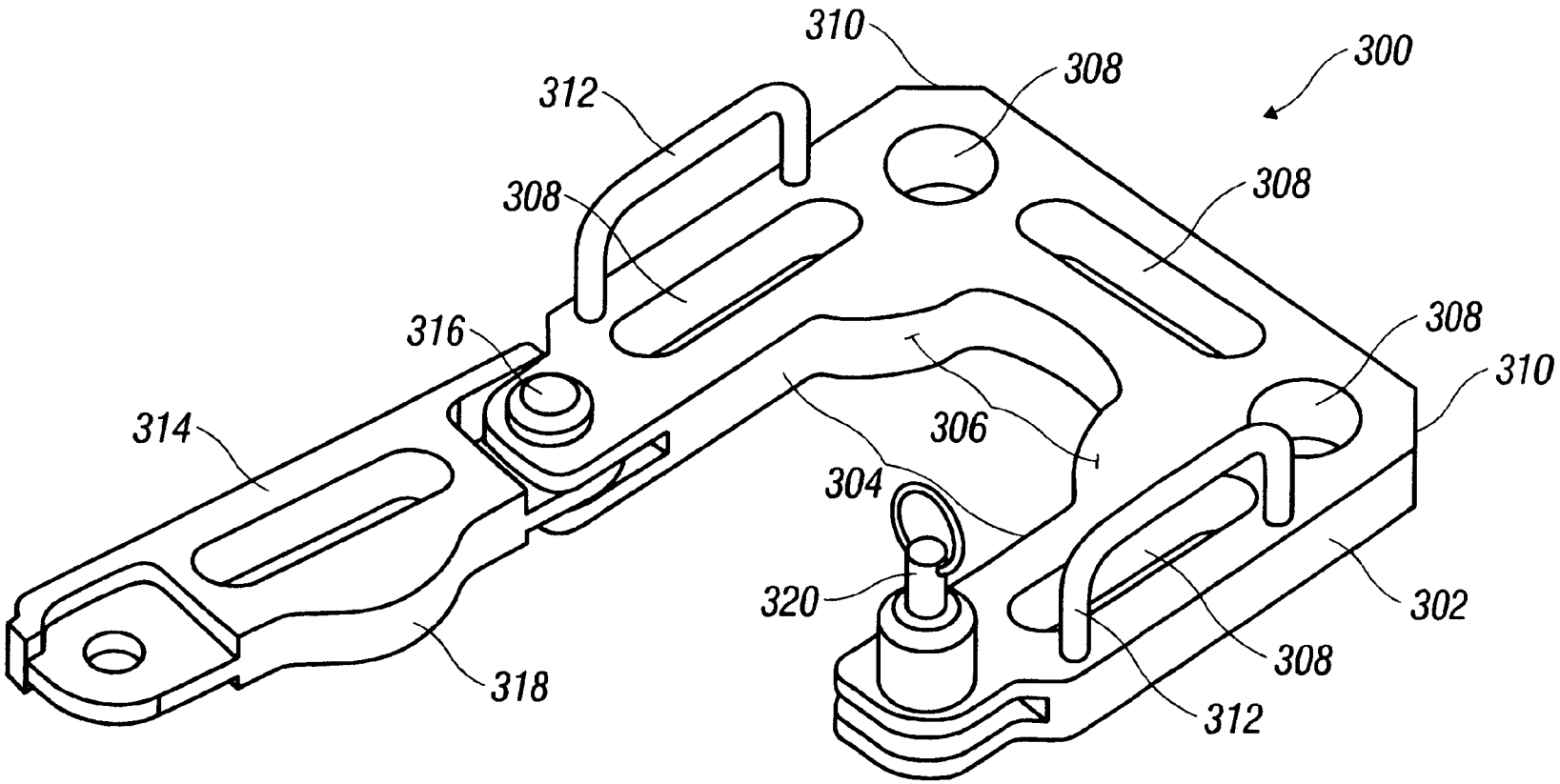
FIG. 1A shows a sample embodiment of the disclosed bit breakers.

Referring to FIG. 1A, which shows one example of the innovative bit breaker in a closed position, the reference numeral 300 generally designates a bit breaker tool, embodying features of the disclosed inventions. The bit breaker 300 includes a generally square, planar, U-shaped base 302 fabricated from steel or other suitable material. The exterior of base 302 is dimensioned to allow a slip fit insertion into the rotary table of a drilling rig (not shown). At the front of base 300 is a chuck opening 304. Within chuck opening 304, base 302 has a pair of inwardly facing base chocks 306. A series of reliefs 308 are formed in base 302 to reduce the weight of tool 300. Corner chamfers 310 are formed at the corners of base 302 to facilitate insertion and removal of tool 300 in the rotary table (not shown) and to further reduce the weight of tool 300. Handles 312 are attached to base 302 to provide easy handling of tool 300.

Seen in an open position in this drawing, a gate 314 is pivotally attached to one end of unshaped base 302 by a heavy-duty hinge 316. Gate 314 has a gate chock 318 located on its inward-facing side. A gate lock 320 securely attaches gate 314 to base 302 at the end opposite hinge 316. Gate lock 320 may be, for example, a retractable latch pin as illustrated. When gate lock 320 is engaged, as seen in FIG. 1E, gate chock 318 and base chocks 306 are in equally spaced relation to each other and to the center of chuck opening 304.

Figure 1B:
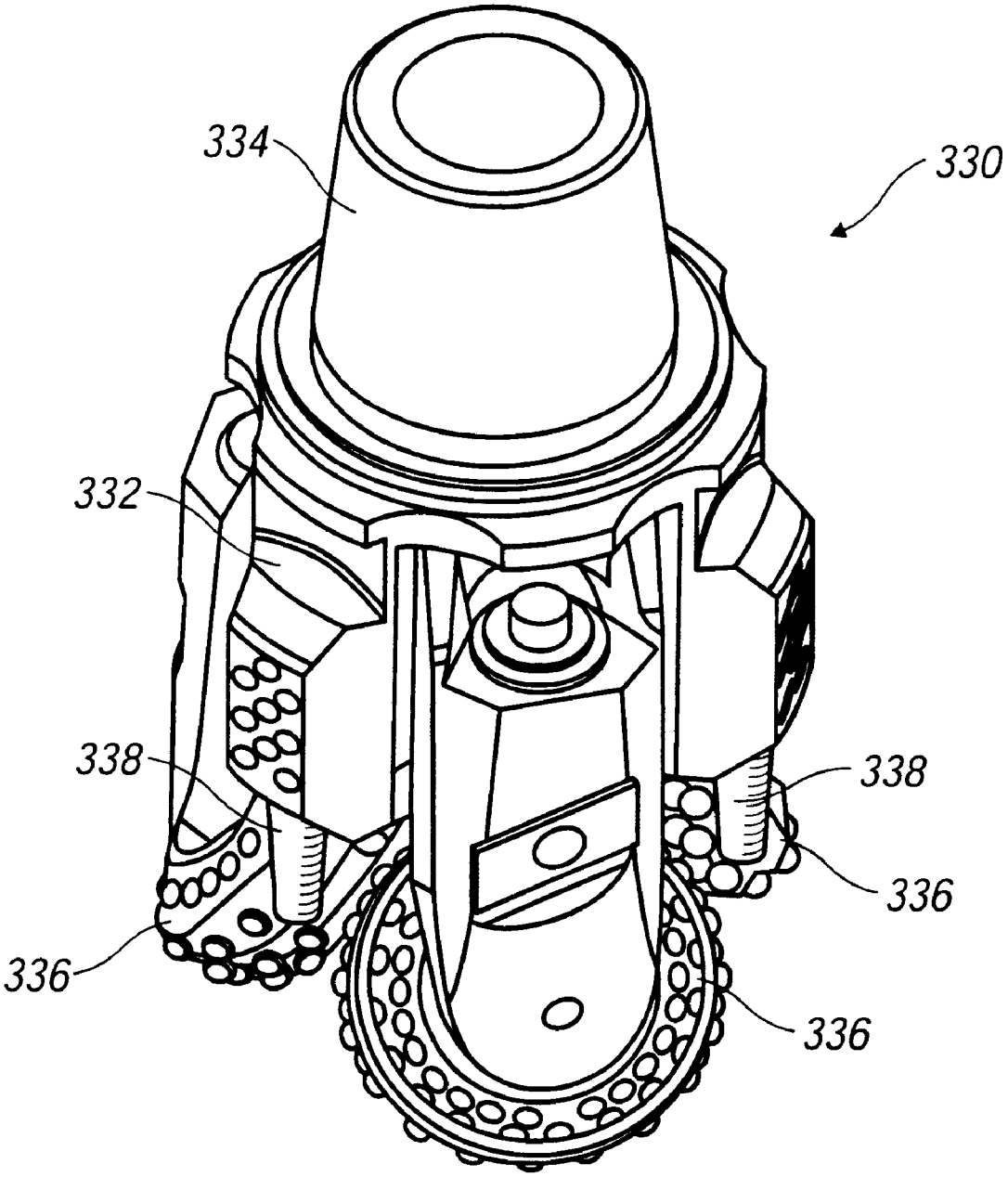
FIG. 1B shows a sample embodiment of the disclosed roller-cone bit to be used with the innovative bit breaker.

FIG. 1B shows an example of a roller cone bit 330, this one having extended nozzles 338, suitable for use with an innovative bit breaker like that shown in FIG. 1A. This bit has three slots 332 machined or otherwise formed in a horizontal plane at equal angular spacing about, and equal radial distances to, the centerline of roller cone bit 330. Slots 332 are located between a threaded tool joint 334 and the cones 336.

Figure 1C:
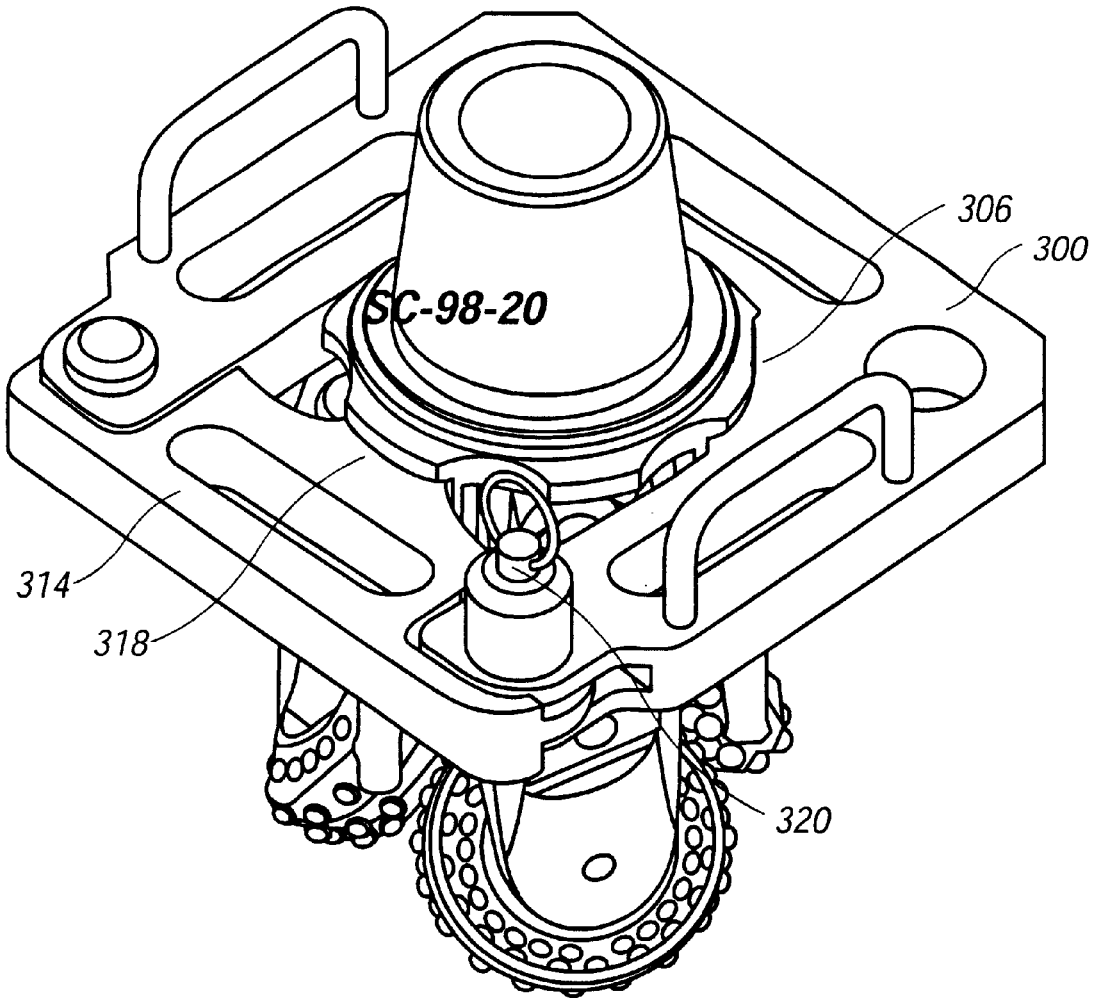
FIG. 1C shows the bit of FIG. 1B retained by the breaker of FIG. 1A.

FIG. 1C shows the exemplary roller cone bit 330 of FIG. 1B engaged by the bit breaker 300 of FIG. 1A. In this drawing, gate 314 has been closed and locked by latch 320, so that chocks 318 and 306 are locked into slots 332 (which are obscured by the chocks) of bit 330. In general use, a stand of pipe to be attached to or detached from the bit would be held in a fixed position while the rotary table, with bit breaker 300 attached, rotates.

Figure 4:
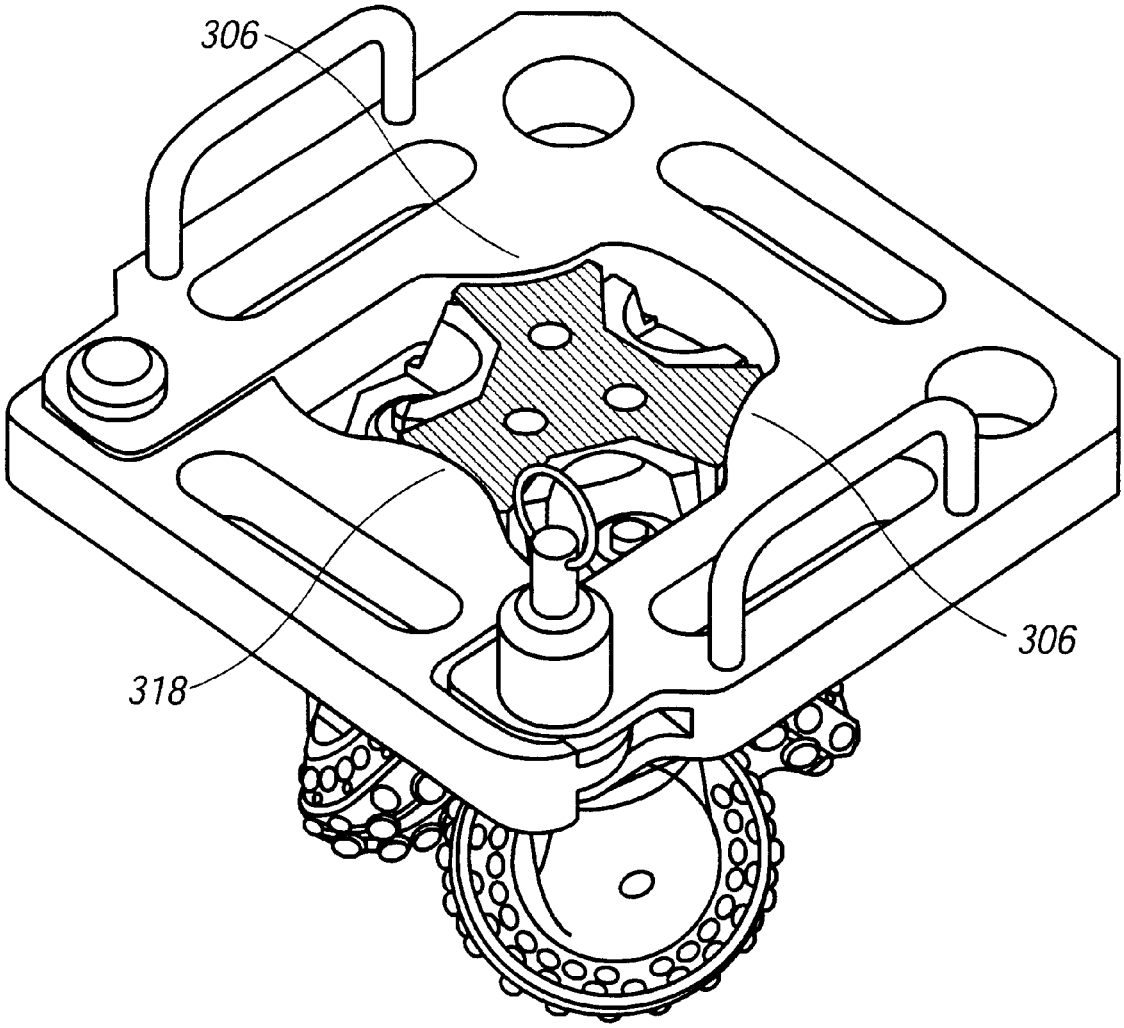
FIG. 4 shows a radial cross-section of a sample embodiment, showing the chocks engage the slots.
Figure 5:
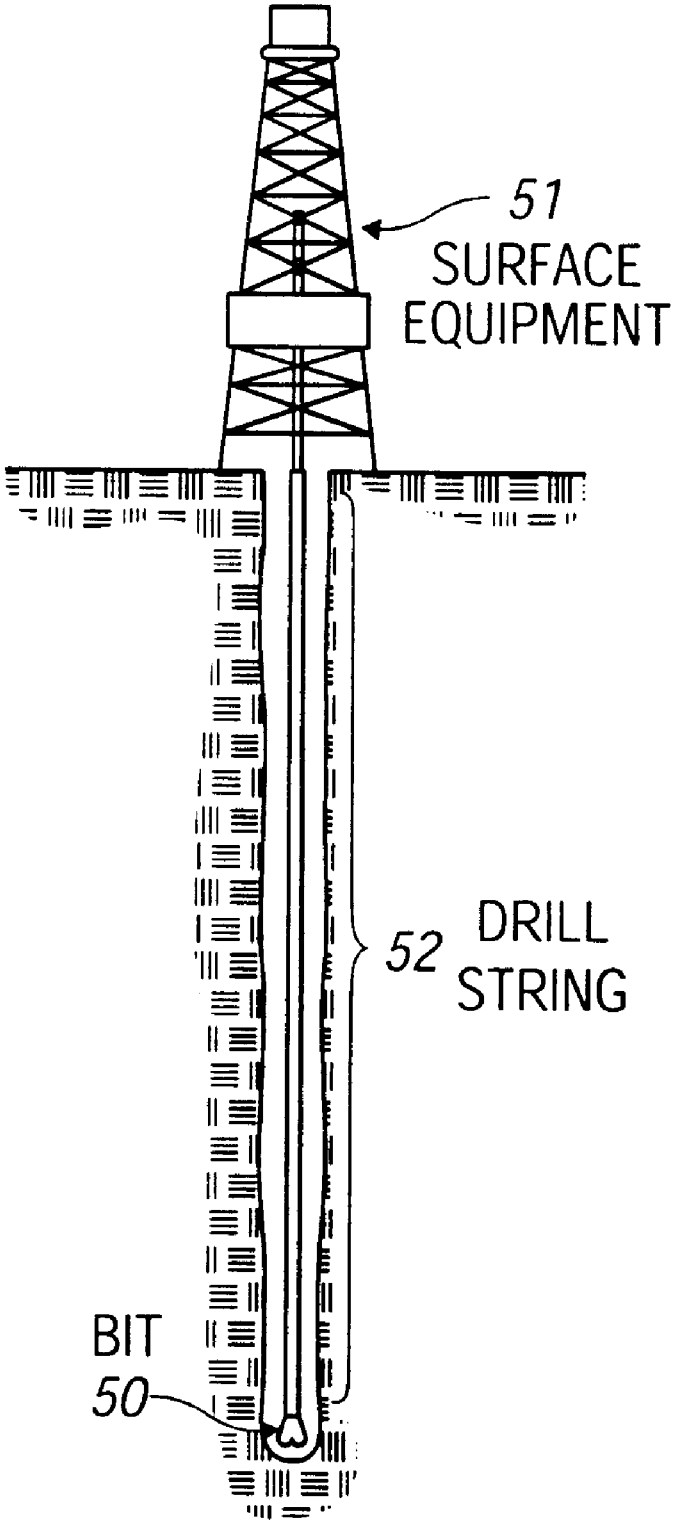
FIG. 5 is an isometric schematic of a contemporary drilling rig.

FIG. 4 gives a further view of a roller cone bit held by the innovative bit breaker, with the top portion of the roller cone bit cut away at the top of slots 332 to show the chocks 318 and 306 engaged in these slots.

Figure 1D:
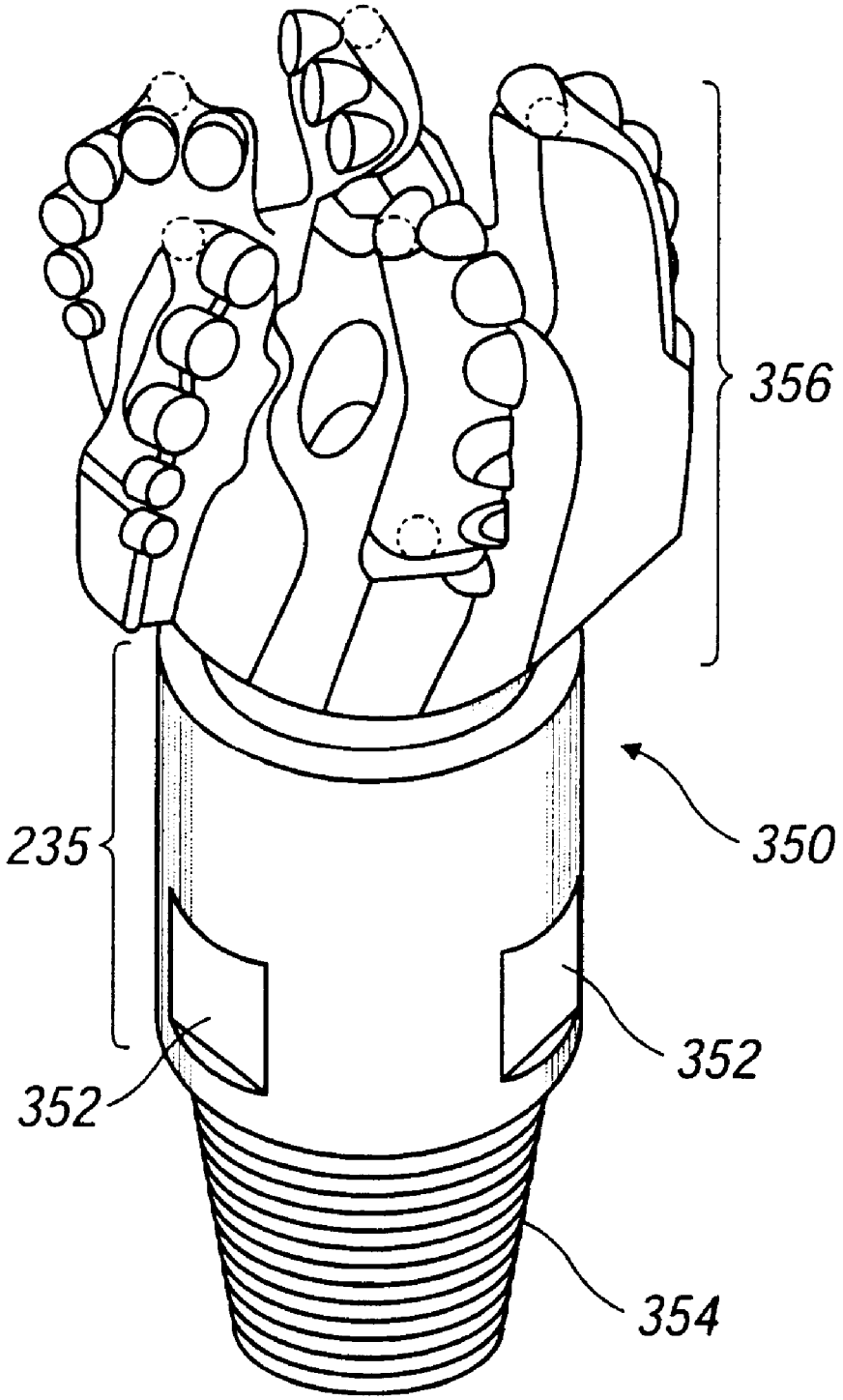
FIG. 1D shows a sample embodiment of the disclosed fixed-cutter bit to be used with the innovative bit breaker.
Figure 1E:
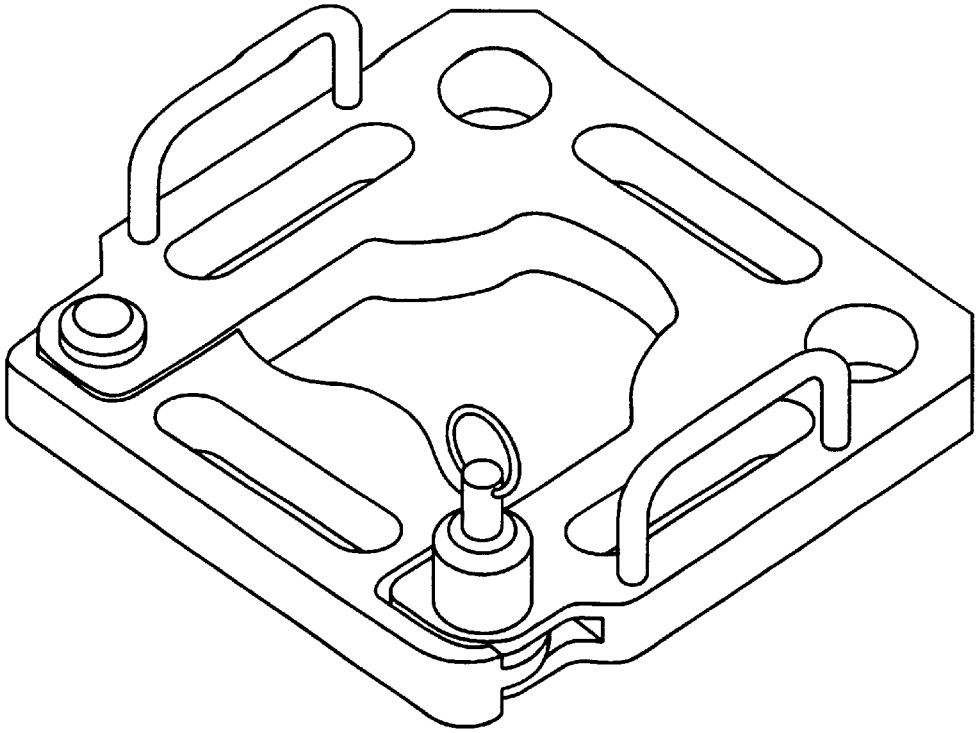
FIG. 1E shows the bit breaker of FIG. 1A in the open position.
Figure 2A:
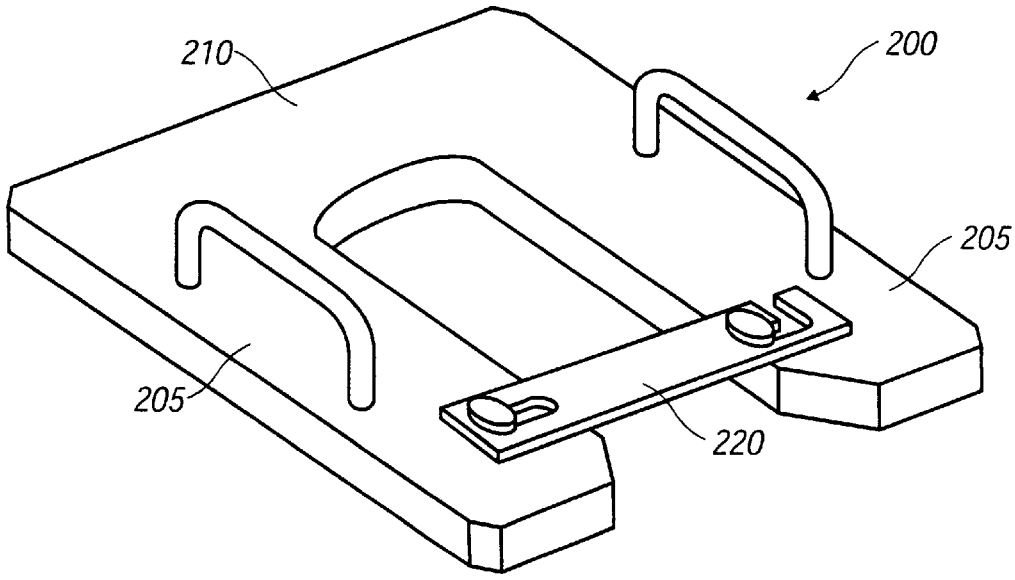
FIG. 2A shows a prior art fixed-cutter bit breaker.
Figure 2B:
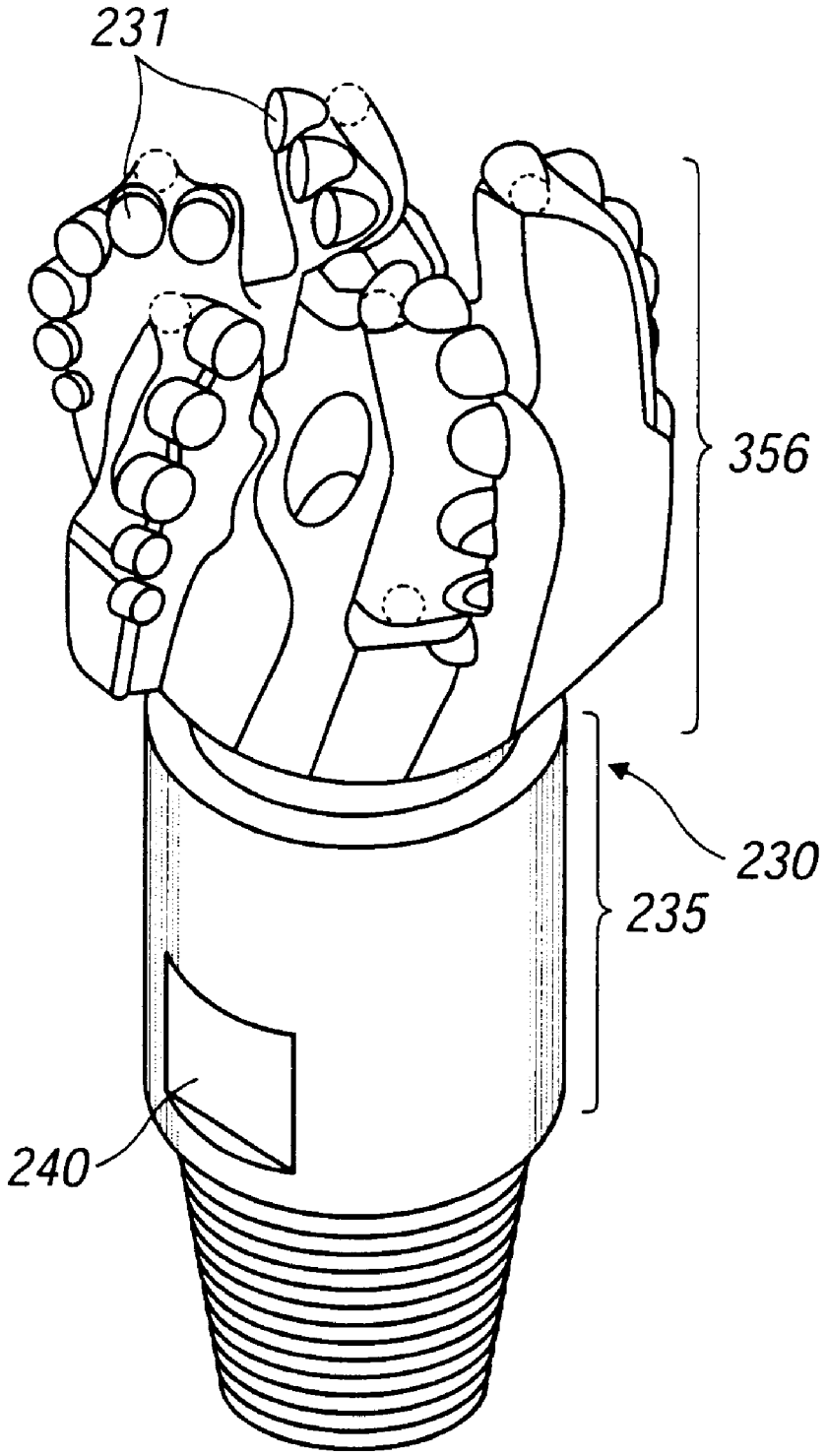
FIG. 2B shows a prior art fixed-cutter bit.
Figure 3A:
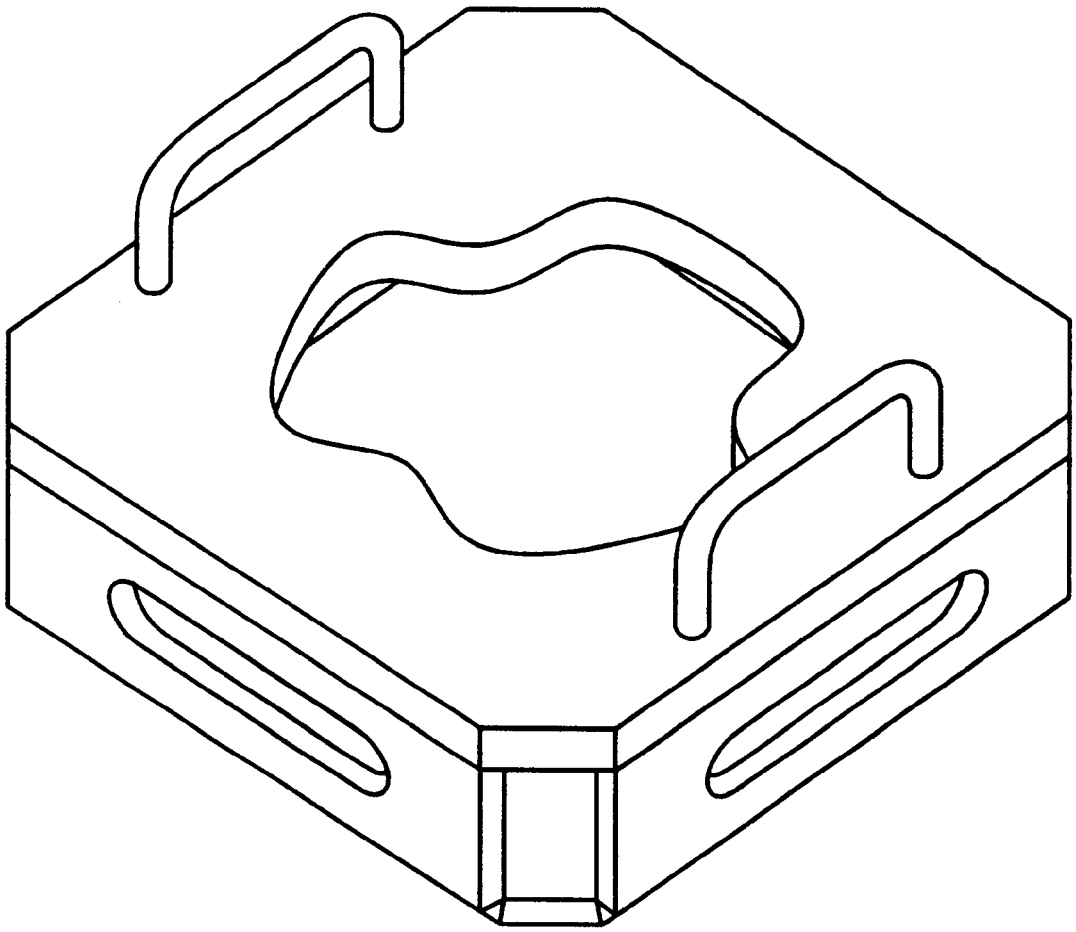
FIG. 3A shows a prior art roller cone bit breaker.
Figure 3B:
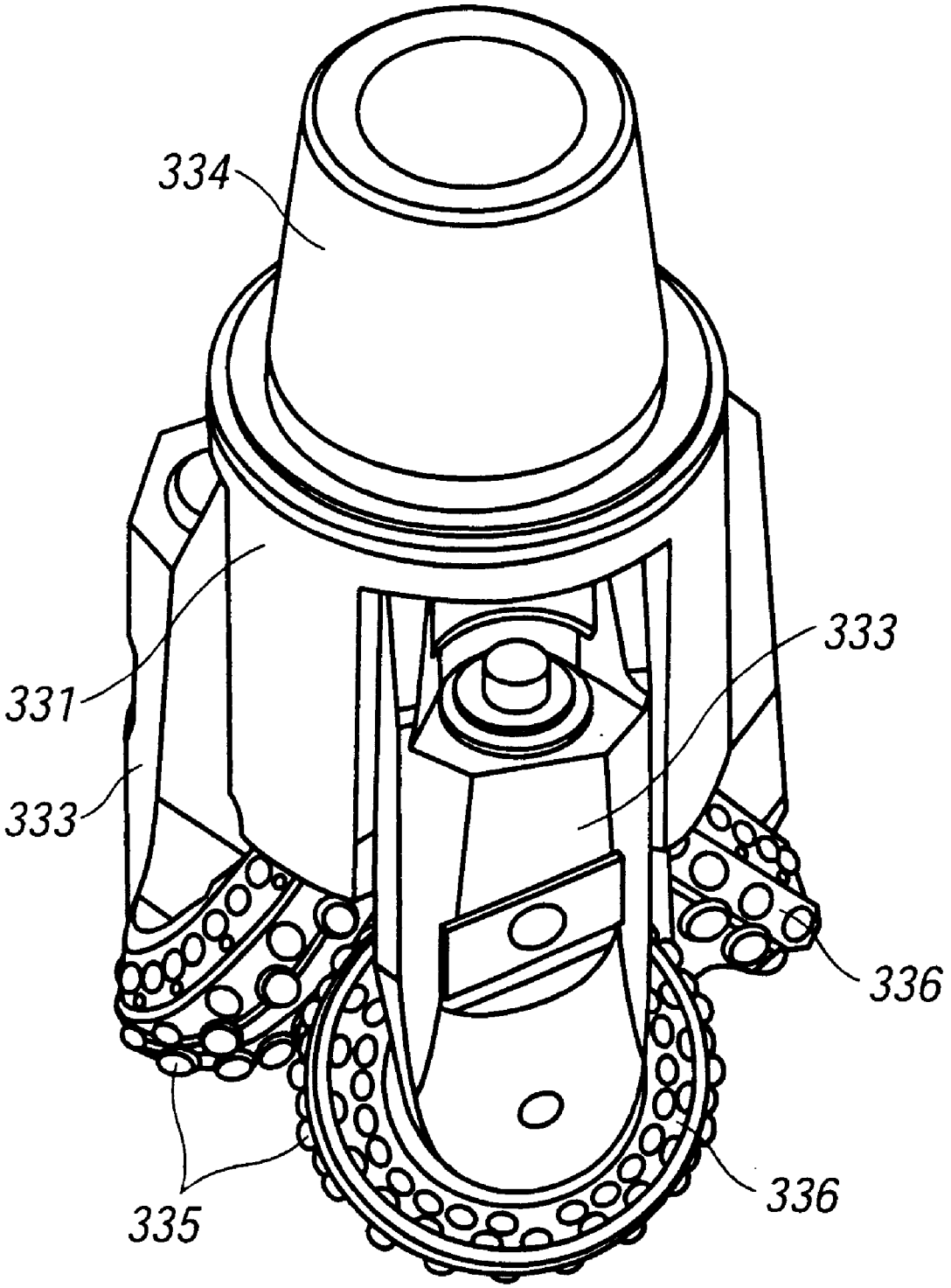
FIG. 3B shows a prior art roller cone bit.
Figure 3C:
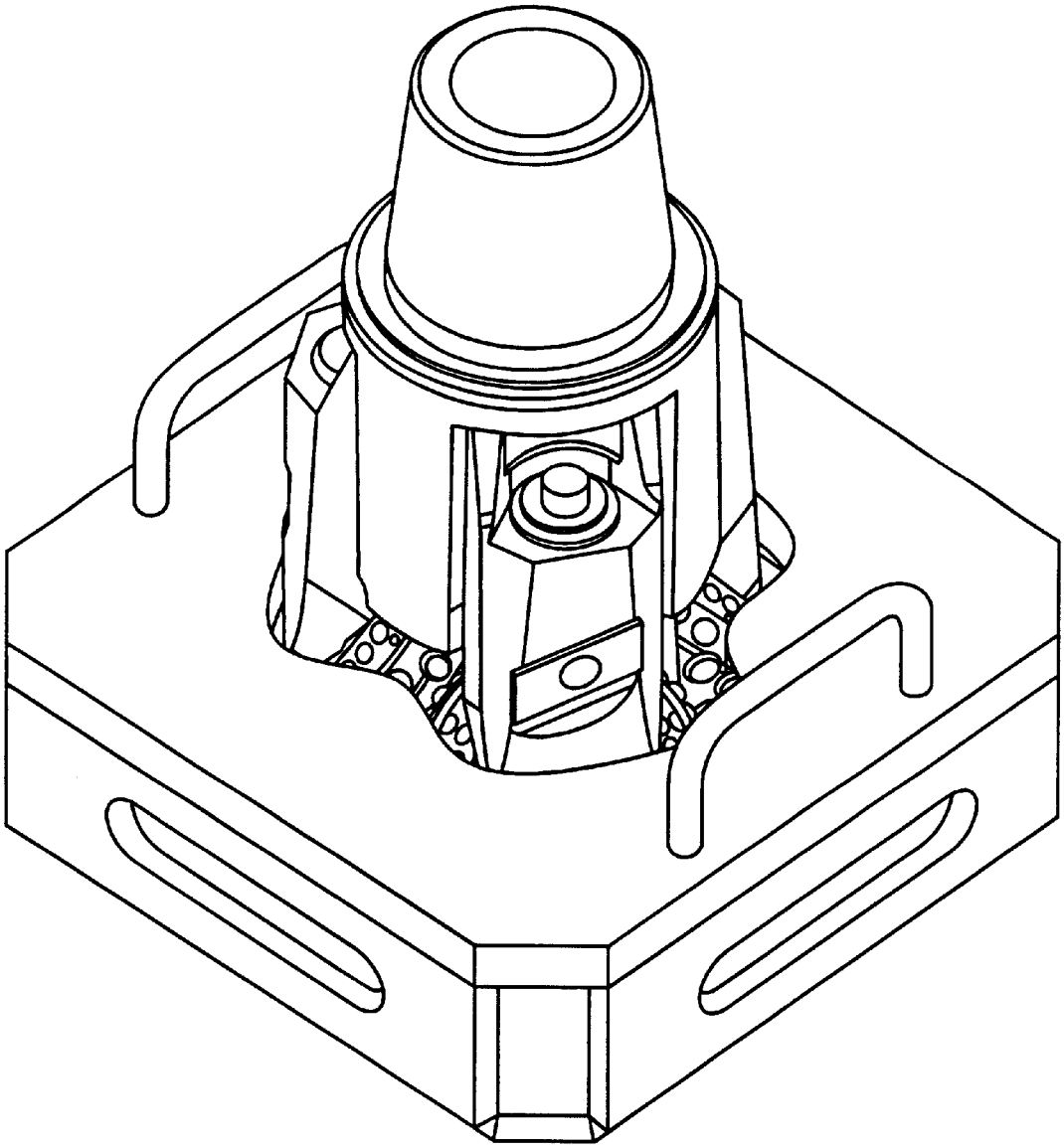
FIG. 3C shows the bit of FIG. 3B retained by the breaker of FIG. 3A.

Shown in FIG. 1D is a fixed cutter bit 350 which has been modified to work with the innovative bit breaker. This bit has three slots 352 machined or otherwise formed in a horizontal plane at equal angular spacing about, and equal radial distances to, the centerline of fixed cutter bit 350. Slots 352 are located on shank 235 between a tool joint 354 and the bit head 356. Bit 350 will fit into the bit breaker in a similar manner as does roller cone bit 330, with slots 352 being gripped by chocks 318 and 306.

Alternative Embodiment: Corner Chamfers

In an alternate preferred embodiment, corner chamfers are minimized, and side reliefs are added to substantially reduce the weight of tool. In this embodiment, the corner contact reduces the relative rotation and impact within the rotary table when torque is applied.

In another contemplated alternative, corner chamfers are large enough to remove at least 30% of the linear edge of the base, thus substantially reducing the weight of tool.

Alternative Embodiment: L-shaped Gate

In another contemplated embodiment, an L-shaped base is combined with a gate which is also generally L-shaped. In this embodiment too, the base and gate preferably have three chocks between them. In this embodiment, a single base can be used in combination with more than one gate to accommodate a larger range of bit diameters, resulting in manufacturing and material cost savings.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, although the preferred embodiments have been described with reference to the rotary-tabled drilling rigs which are more commonly used (except in offshore rigs and very deep holes), the disclosed inventions can also be applied to top driven rotary systems as well.

In another contemplated embodiment, the gate chock is particularly customized in its geometry (as opposed to base chocks) to provide additional closeness of fit of the rock bit to the bit breaker.

In another contemplated embodiment, base chocks are replaceable, rather than being integral with the plate.

In another contemplated embodiment, the gate corner radii are reduced, to more closely match the back of the base to improve contact (reduce clearance rotation of bit breaker) when torque is applied. This can be done and still accommodate rotation of the gate against the pivoted end.

In another contemplated embodiment, relief indentations can be added along middle portions of the bit breaker's sides, instead of (or in addition to) the weight-reducing cutouts in the sides of the tool, In a further contemplated alternative, replaceable chocks or sleeves can be combined with the disclosed embodiment to accommodate larger size ranges.

In a further contemplated alternative, the inwardly-pointing chock lobes can be azimuthally asymmetrical, so that the breaker plate would be turned upside down to change from makeup to breakout. (Again, this would require rig floor personnel to make this change correctly.)

In a further contemplated alternative, the number of slots on a bit can be a multiple of three, so that the bit breaker can engage the bit at more angular positions.

In another contemplated mode of use, a stand can be used to allow safe floor assembly of the bit breaker to the drill bit, and subsequent hoisting of both (by a lifting sub) into the rotary table.

The following publications, all of which are hereby incorporated by reference, provide additional detail regarding possible implementations of the disclosed embodiments, and of modifications and variations thereof. Kate Van Dyke, The Bit (4.ed. 1995), together with all other volumes in the Rotary Drilling Series from Petroleum Extension Service; Jim Short, Introduction to Directional and Horizontal Drilling (PennWell 1993); J.-P. Nguyen, Drilling (Technip 1996); Wilson Chin, Wave Propagation in Petroleum Engineering (Gulf 1994); Bourgoyne et al., Applied Drilling Engineering (S.P.E. 1991); and the proceedings volumes of all of the IADC/SPE Drilling Conferences.

According to a disclosed class of innovative embodiments, there is provided: A bit breaker for connecting and disconnecting threaded connections comprising: a base having at least one open side, and having a chuck opening portion, and having a pair of chocks extending into the chuck opening; and a gate removably located against the open side of the base, and having a chock extending into the chuck opening.

According to another disclosed class of innovative embodiments, there is provided: A bit breaker, comprising: a base having at least one open side, and having a chuck opening portion, and having a pair of chocks extending into the chuck opening; and a gate removably located against the open side of the base, and having a chock extending into the chuck opening; wherein said base and said gate contain cutouts which reduce the weight of said bit breaker; wherein said base has first, second, and third outer edges, said first and third outer edges being substantially parallel and said second outer edge being substantially parallel with the outer edge of said gate, when said gate is in a closed position.

According to another disclosed class of innovative embodiments, there is provided: A bit breaker, comprising: a base having at least one open side, and having a chuck opening portion, and having a pair of chocks extending into the chuck opening; and a gate removably located against the open side of the base, and having a chock extending into the chuck opening; at least one handle attached to said base; wherein said base has first, second, and third outer edges, said first and third outer edges being substantially parallel and said second outer edge being substantially parallel with the outer edge of said gate, when said gate is in a closed position; wherein said chocks of said base and said gate are equidistant from each other when said gate is in a closed position.

According to another disclosed class of innovative embodiments, there is provided: A rock drill bit, comprising three breaking slots.

According to another disclosed class of innovative embodiments, there is provided: A rock drill bit, comprising: three arms in a fixed spatial relationship; rotatable subassemblies mounted on ones of said arms, and having rock-cutting elements mounted thereon; and three breaking slots, each positioned between two of said arms.

According to another disclosed class of innovative embodiments, there is provided: A rock drill bit, comprising: three arms in a fixed spatial relationship with a body which includes a thread; rotatable subassemblies mounted on ones of said arms, and having rock-cutting elements mounted thereon; jets mounted in and extending from said body; and three breaking slots, each positioned between two of said arms.

According to another disclosed class of innovative embodiments, there is provided: A drilling system, comprising: a drill string containing at least one section of pipe; a drill bit comprising three breaking slots and a threaded connector for attachment to said drill string; surface equipment capable of turning said drill bit in relation to said drill string; and a bit breaker, attached to said surface equipment, for connecting and disconnecting threaded connections, said bit breaker comprising: a base having at least one open side, and having a chuck opening portion, and having a pair of chocks extending into the chuck opening; and a gate removably located against the open side of the base, and having a chock extending into the chuck opening.

According to another disclosed class of innovative embodiments, there is provided: A method for connecting a drill bit to a drill string member on a drilling rig, comprising the steps of: placing a bit breaker having an open end and a pair of inwardly directed chocks onto a drill bit having three slots; attaching a gate having an inwardly directed chock, across the open end of the bit breaker; placing a drill string member onto the drill bit such that a lower tool joint connection of the drill string member is positioned for threaded connection to the tool joint of the bit breaker; and, applying opposing torque between the bit breaker and the drill string member to connect the drill string member to the drill bit.

According to another disclosed class of innovative embodiments, there is provided: A method for disconnecting a drill bit from a drill string member on a drilling rig comprising the steps of: placing a bit breaker having an open end and a pair of inwardly directed chocks onto a drill bit having three slots; attaching a gate having an inwardly directed chock across the open end of the bit breaker; and applying opposing torque between the bit breaker and the drill string member to disconnect the drill string member from the drill bit According to another disclosed class of innovative embodiments, there is provided: A method of drill rig operation, comprising the steps of: (a.) using a first bit breaker which has at least three chocks, including a torque-transmitting chock mounted on an openable gate, during makeup/breakout operations to define the rotational position of bits which have slots complementary to said chocks, including both roller-cone and fixed-cutter type bits.

Definitions:

Following are short definitions of the usual meanings of some of the technical terms which are used in the present application. (However, those of ordinary skill will recognize whether the context requires a different meaning.) Additional definitions can be found in the standard technical dictionaries and journals.

Fixed-cutter bit: a drill bit with no moving parts that drills by intrusion and drag, also called a drag bit.

Mud: the liquid circulated through the wellbore during rotary drilling operations, also referred to as drilling fluid. Originally a suspension of earth solids (especially clays) in water, modern "mud" is a three-phase mixture of liquids, reactive solids, and inert solids.

Nozzle: in a passageway through which the drilling fluid exits a drill bit, the portion of that passageway which restricts the cross-section to control the flow of fluid.

Roller cone bit: a drilling bit made of two, three, or four cones, or cutters, that are mounted on extremely rugged bearings. The cones" are typically conical or frustro-conical, but may also include some paraboloidal convexity. The surface of each cone is made up of rows of steel teeth or rows of tungsten carbide inserts.

Bit breaker: a device which can be attached to the rotary table to keep the drill bit from turning with respect to the rotary table when torque is applied to the joint between the bit and a stand of pipe.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

What is claimed is:

1. A bit breaker for connecting and disconnecting threaded connections comprising:

a base having at least one open side, and having a chuck opening portion, and having a pair of chocks extending into the chuck opening; and a gate removably located against the open side of the base, and having a chock extending into the chuck opening.

2. The bit breaker of claim 1, further comprising: a pair of detachable connectors securing the gate to the base, one each on opposite ends of the gate.

3. The bit breaker of claim 1, further comprising a pivotal attachment securing one end of the gate to the base in rotational relationship.

4. The bit breaker of claim 1, further comprising a detachable connector securing the gate to the base on the end of the gate opposite to the pivotal attachment.

5. The bit breaker of claim 1, further comprising at least one handle attached to the base for lifting the bit breaker.

6. A bit breaker, comprising:

a base having at least one open side, and having a chuck opening portion, and having a pair of chocks extending into the chuck opening; and a gate removably located against the open side of the base, and having a chock extending into the chuck opening;

wherein said base and said gate contain cutouts which reduce the weight of said bit breaker;

wherein said base has first, second, and third outer edges, said first and third outer edges being substantially parallel and said second outer edge being substantially parallel with an outer edge of said gate, when said gate is in a closed position.

7. The bit breaker of claim 6, further comprising a pair of detachable connectors securing the gate to the base, one each on opposite ends of the gate.

8. The bit breaker of claim 6, further comprising a pivotal attachment securing one end of the gate to the base in rotational relationship.

9. The bit breaker of claim 8, further comprising a detachable connector securing the gate to the base on the end of the gate opposite to the pivotal attachment.

10. The bit breaker of claim 6, further comprising at least one handle attached to the base for lifting the bit breaker.

11. A bit breaker, comprising:

a base having at least one open side, and having a chuck opening portion, and having a pair of chocks extending into the chuck opening; and a gate removably located against the open side of the base, and having a chock extending into the chuck opening;

at least one handle attached to said base;

wherein said base has first, second, and third outer edges, said first and third outer edges being substantially parallel and said second outer edge being substantially parallel with an outer edge of said gate, when said gate is in a closed position;

wherein said chocks of said base and said gate are equidistant from each other when said gate is in a closed position.

12. The bit breaker of claim 11, further comprising a pair of detachable connectors securing the gate to the base, one each on opposite ends of the gate.

13. The bit breaker of claim 11, further comprising a pivotal attachment securing one end of the gate to the base in rotational relationship.

14. The bit breaker of claim 13, further comprising a detachable connector securing the gate to the base on the end of the gate opposite to the pivotal attachment.

15. A drilling system, comprising:

a drill string containing at least one section of pipe;

a drill bit comprising three breaking slots and a threaded connector for attachment to said drill string;

surface equipment capable of turning said drill bit in relation to said drill string; and a bit breaker, attached to said surface equipment, for connecting and disconnecting threaded connections, said bit breaker comprising:

a base having at least one open side, and having a chuck opening portion, and having a pair of chocks extending into the chuck opening; and a gate removably located against the open side of the base, and having a chock extending into the chuck opening.

16. A method for connecting a drill bit to a drill string member on a drilling rig, comprising the steps of:

placing a bit breaker having an open end and a pair of inwardly directed chocks onto a drill bit having three slots;

attaching a gate having an inwardly directed chock, across the open end of the bit breaker;

placing a drill string member onto the drill bit such that a lower tool joint connection of the drill string member is positioned for threaded connection to the tool joint connection of the bit breaker; and, applying opposing torque between the bit breaker and the drill string member to connect the drill string member to the drill bit.

17. The method of claim 16, wherein the attaching step also engages said chock of said gate into one of said slots of said bit.

18. The method of claim 16, wherein the step of attaching a gate further comprises: pivoting said gate about a hinged connection between one end of said gate and one end of said bit breaker.

19. The method of claim 16, wherein the step of attaching a gate further comprises: engaging a retractable pin between said bit breaker and the gate end.

20. A method for disconnecting a drill bit from a drill string member on a drilling rig comprising the steps of:

placing a bit breaker having an open end and a pair of inwardly directed chocks onto a drill bit having three slots;

attaching a gate having an inwardly directed chock across the open end of the bit breaker; and applying opposing torque between the bit breaker and the drill string member to disconnect the drill string member from the drill bit.

21. The method of claim 20, wherein the attaching step also engages said chock of said gate into one of said slots of said bit.

22. The method of claim 20, wherein the step of attaching a gate further comprises: pivoting the gate about a hinged connection between one end of the gate and one end of the bit breaker.

23. The method of claim 20, wherein the step of attaching a gate further comprises: engaging a retractable pin between said bit breaker and the gate end.

24. A method of drill rig operation, comprising the step of using, during a makeup/breakup operation, a first bit breaker which has at least three chocks, including a torque-transmitting chock mounted on an openable gate, to connect and disconnect a bit to a drill string, said bit having slots complementary to said chocks.

* * * * *